US010770252B2

(12) United States Patent
Zhang

(10) Patent No.: US 10,770,252 B2
(45) Date of Patent: Sep. 8, 2020

(54) MAGNETIC SYSTEM OF ELECTROMAGNETIC RELAY

(71) Applicant: Tyco Electronics (Shenzhen) Co. Ltd., Guangdong (CN)

(72) Inventor: Xiaoning Zhang, Guangdong (CN)

(73) Assignee: Tyco Electronics (Shenzhen) Co. Ltd., Guangdong (CN)

( * ) Notice: Subject to any disclaimer, the term of this patent is extended or adjusted under 35 U.S.C. 154(b) by 110 days.

(21) Appl. No.: 15/856,646

(22) Filed: Dec. 28, 2017

(65) Prior Publication Data

US 2018/0122604 A1 May 3, 2018

Related U.S. Application Data

(63) Continuation of application No. PCT/IB2016/053739, filed on Jun. 23, 2016.

(30) Foreign Application Priority Data

Jun. 30, 2015 (CN) ..... 2015 1 0371849

(51) Int. Cl.
*H01H 51/22* (2006.01)
*H01H 50/40* (2006.01)
(Continued)

(52) U.S. Cl.
CPC ..... *H01H 50/40* (2013.01); *H01F 7/14* (2013.01); *H01H 50/26* (2013.01); *H01H 50/28* (2013.01); *H01H 51/2236* (2013.01)

(58) Field of Classification Search
CPC . H01H 51/2272; H01H 51/2236; H01H 50/24
(Continued)

(56) References Cited

U.S. PATENT DOCUMENTS 656,796 A * 8/1900 Thompson ..... H01H 50/24 335/276
738,801 A * 9/1903 Hedman ..... H01H 50/24 335/276
(Continued)

FOREIGN PATENT DOCUMENTS

AT 410855 B 8/2003
DE 1439210 A1 1/1969
(Continued)

OTHER PUBLICATIONS

PCT International Search Report and Written Opinion of the International Searching Authority, dated Aug. 29, 2016, 11 pages.

*Primary Examiner* — Alexander Talpalatski
(74) *Attorney, Agent, or Firm* — Barley Snyder

(57) ABSTRACT

A magnetic system of an electromagnetic relay comprises a coil, an iron core, a yoke, and an armature. The iron core extends through the coil and has a first end and a second end opposite to the first end. A second part of the yoke is connected to the first end of the iron core and a first part of the yoke extends in a length direction of the iron core and is separated from the coil. The armature is disposed at the second end of the iron core and has a main body and a bending portion bent from the main body by a predetermined angle. The main body faces an end surface of the second end of the iron core. The bending portion is disposed at an inner side of an end portion of the first part of the yoke and faces the iron core.

15 Claims, 2 Drawing Sheets

(51) Int. Cl.
*H01H 50/26* (2006.01)
*H01F 7/14* (2006.01)
*H01H 50/28* (2006.01)

(58) Field of Classification Search
USPC ..... 335/78, 129, 80
See application file for complete search history.

(56) References Cited

U.S. PATENT DOCUMENTS 969,759 A * 9/1910 Clement ..... H01H 51/06 335/128
2,134,951 A * 11/1938 Piesker ..... H01H 51/2236 335/239
3,958,200 A * 5/1976 Mally ..... H01H 1/26 335/275
4,004,260 A * 1/1977 Happach ..... H01H 50/042 335/202
4,691,181 A * 9/1987 Katsutani ..... H01H 50/26 335/128
4,728,917 A * 3/1988 Kimpel ..... H01H 51/2236 335/274
4,949,058 A * 8/1990 Nishikawa ..... H01H 50/18 335/128
5,243,312 A * 9/1993 Schedele ..... H01H 50/026 335/128
5,289,145 A * 2/1994 Schedele ..... H01H 50/026 335/128
5,352,999 A * 10/1994 Hoffmann ..... H01H 50/14 324/418
5,892,423 A * 4/1999 Haas ..... H01H 49/00 335/128
5,894,254 A * 4/1999 Reiter ..... H01H 50/28 335/128
6,486,760 B2 * 11/2002 Miyazaki ..... H01H 50/36 335/129
6,545,575 B1 * 4/2003 Hirabayashi ..... H01H 50/042 335/128
7,283,026 B2 * 10/2007 Nakamura ..... H01H 50/043 335/202
2015/0187525 A1 * 7/2015 Mills ..... H01F 7/122 335/203

FOREIGN PATENT DOCUMENTS

DE 1489972 A1 5/1969
EP 0707331 A1 4/1996
GB 2137813 A 10/1984

* cited by examiner

MAGNETIC SYSTEM OF ELECTROMAGNETIC RELAY

CROSS-REFERENCE TO RELATED APPLICATIONS

This application is a continuation of PCT International Application No. PCT/IB2016/053739, filed on Jun. 23, 2016, which claims priority under 35 U.S.C. § 119 to Chinese Patent Application No. 201510371849.4, filed on Jun. 30, 2015.

FIELD OF THE INVENTION

The present invention relates to an electromagnetic relay and, more particularly, to a magnetic system of an electromagnetic relay.

BACKGROUND

A magnetic system of an electromagnetic relay generally known in the art comprises an iron core, a coil, a yoke, and an armature. The iron core passes through the coil. A first end of the iron core is connected to the yoke. The armature is disposed at a second end of the iron core opposite the first end and faces an end surface of the second end of the iron core. A surface of the armature faces an end surface of the yoke and contacts an edge of the yoke.

In a magnetic circuit of the existing electromagnetic relay, a cross sectional area of a magnetic gap between the yoke and the armature is defined by an area of the end surface of the yoke. Since the area of the end surface of the yoke is limited by a thickness of the yoke, the cross sectional area of the magnetic gap between the yoke and the armature is limited by the thickness of the yoke. In order to increase the cross sectional area of the magnetic gap between the yoke and the armature, in a yoke design of some manufacturers, the edge of the yoke abutting against the armature is stamped to increase the thickness of the end portion of the yoke and the cross sectional area of the magnetic gap. However, this solution complicates the manufacturing process and reduces manufacturing efficiency.

SUMMARY

A magnetic system of an electromagnetic relay according to the invention comprises a coil, an iron core, a yoke, and an armature. The iron core extends through the coil and has a first end and a second end opposite to the first end. A second part of the yoke is connected to the first end of the iron core and a first part of the yoke extends in a length direction of the iron core and is separated from the coil. The armature is disposed at the second end of the iron core and has a main body and a bending portion bent from the main body by a predetermined angle. The main body faces an end surface of the second end of the iron core. The bending portion is disposed at an inner side of an end portion of the first part of the yoke and faces the iron core.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
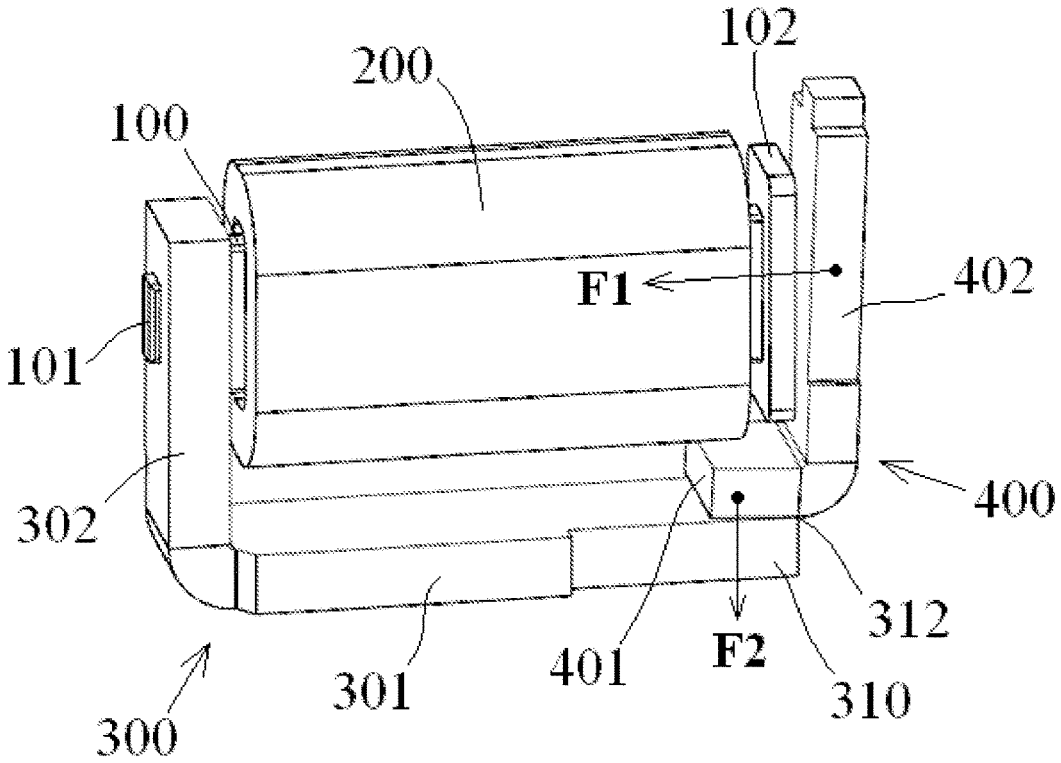
FIG. 1 is a perspective view of an electromagnetic relay according to an embodiment.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will be thorough and complete and will fully convey the concept of the disclosure to those skilled in the art.

Figure 2:
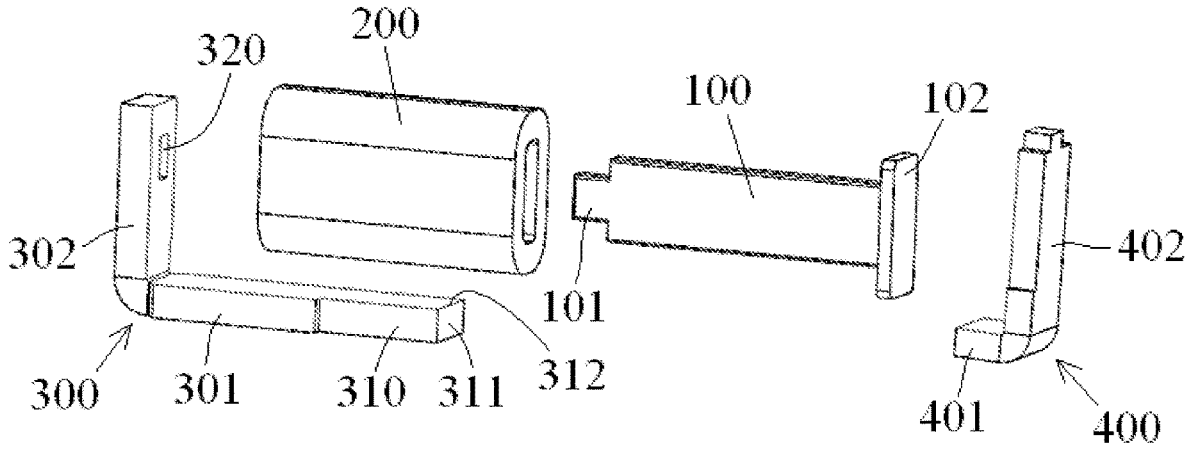
FIG. 2 is an exploded perspective view of the electromagnetic relay of FIG. 1.

A magnetic system of an electromagnetic relay according to an embodiment is shown in FIGS. 1 and 2. The electromagnetic relay comprises an iron core 100, a coil 200, a yoke 300, and an armature 400.

The iron core 100, as shown in FIGS. 1 and 2, passes through the coil 200 and has a first end 101 and a second end 102 opposite to the first end 101. The yoke 300 is connected to the first end 101 of the iron core 100. The armature 400 is disposed at the second end 102 of the iron core 100 and faces an end surface of the second end 102 of the iron core 100.

In the shown embodiment, the iron core 100 has a rectangular cross section. In other embodiments, the iron core 100 may have a round cross section, an oval cross section, or any other suitable shaped cross section.

The yoke 300, as shown in FIGS. 1 and 2, comprises a first part 301 and a second part 302 substantially perpendicular to the first part 301. The first part 301 is integrally connected to the second part 302. The yoke 300 substantially exhibits an L-shape as a whole. An installation hole 320, as shown in FIG. 2, is formed in the second part 302 of the yoke 300. The first part 301 of the yoke 300 has a length substantially equal to a length of the iron core 100 and is formed in a flat-plate shape.

As shown in FIGS. 1 and 2, the second part 302 of the yoke 300 is connected to the first end 101 of the iron core 100. The first end 101 of the iron core 100 is fitted into the installation hole 320 so as to assemble the yoke 300 and the iron core 100 together. The first part 301 of the yoke 300 extends in a length direction of the iron core 100 and is separated from the coil 200. The first part 301 of the yoke 300 is substantially parallel to an axis of the coil 200. The second part 302 of the yoke 300 is substantially perpendicular to the axis of the coil 200. The iron core 100 and the coil 200 have a same axis.

The armature 400, as shown in FIGS. 1 and 2, comprises a main body 402 facing an end surface of the second end 102 of the iron core 100 and a bending portion 401 bent from the main body 402 by a predetermined angle, for example, by 90 degrees. In other embodiments, the bending portion 401 may be bent from the main body 402 by an angle between 70 and 110 degrees, between 80 and 100 degrees, or between 85 and 95 degrees.

The bending portion 401 of the armature 400 is disposed at an inner side, facing the iron core 100, of an end portion 310 of the first part 301 of the yoke 300 as shown in FIGS. 1 and 2, so that the bending portion 401 of the armature 400 is interposed between the iron core 100 and the end portion 310 of the first part 301 of the yoke 300; the bending portion 401 of the armature 400 faces the inner side of the end portion 310 of the first part 301 of the yoke 300. The bending portion 401 of the armature 400 contacts an inner side edge 312 of an end surface 311 of the end portion 310 of the first part 301 of the yoke 300, so that the inner side edge 312 serves as a pivot fulcrum of the armature 400. The armature 400 may be rotated about the inner side edge 312 of the end surface 311. The end portion 310 of the first part 301 of the yoke 300, in an embodiment, has a width substantially equal to a width of the bending portion 401 of the armature 400.

A cross sectional area of a magnetic gap between the yoke 300 and the armature 400 is defined by a surface area of the bending portion 401 of the armature 400 facing the end portion 310 of the yoke 300. Thereby, it is possible to increase the cross-sectional area of the magnetic gap between the armature 400 and the yoke 300 by increasing the surface area of the bending portion 401 of the armature facing the yoke 300. In this way, it is easy to increase the electromagnetic attraction force exerted on the armature 400 by the yoke 300.

As shown in FIG. 1, the iron core 100 exerts a first electromagnetic attraction force F1 on the main body 402 of the armature 400 in a substantially horizontal direction. The first electromagnetic attraction force F1 produces a first torque on the armature 400 with respect to the pivot fulcrum (the inner side edge 312). The yoke 300 exerts a second electromagnetic attraction force F2 on the bending portion 401 of the armature 400 in a substantially perpendicular direction. The second electromagnetic attraction force F2 produces a second torque on the armature 400 with respect to the pivot fulcrum (the inner side edge 312). As shown in FIG. 1, the first torque produced by the first electromagnetic attraction force F1 and the second torque produced by the second electromagnetic attraction force F2 have the same direction (for example, counter-clockwise direction in FIG. 1) with respect to the pivot fulcrum (the inner side edge 312). A total torque exerted on the armature 400 is equal to the sum of the first torque and the second torque.

Figure 3:
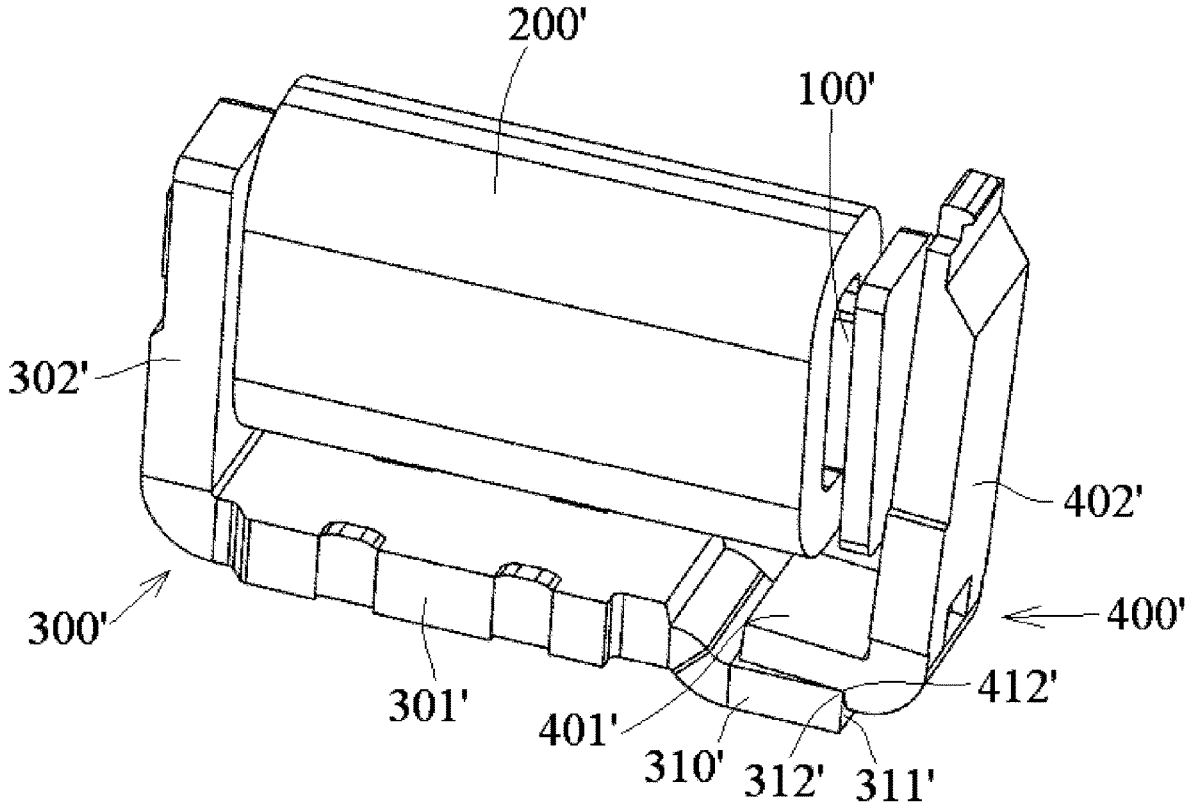
FIG. 3 is a perspective view of an electromagnetic relay according to another embodiment.

An electromagnetic relay according to another embodiment of the invention is shown in FIG. 3. The electromagnetic relay comprises an iron core 100', a coil 200', a yoke 300', and an armature 400'. The electromagnetic relay of the embodiment of FIG. 3 is similar to the embodiment of FIGS. 1 and 2; like reference numbers refer to like elements and only the differences from the embodiment shown in FIGS. 1 and 2 will be described in detail herein.

As shown in FIG. 3, an end portion 310' of a first part 301' of the yoke 300' is bent away from the iron core 100' with respect to a main body portion (the other portion except the end portion 310') of the first part 301', so as to increase a distance between the end portion 310' of the first part 301' of the yoke 300' and the coil 200'. In this way, a distance between an bending portion 401' of the armature 400' and the coil 200' as well as a distance between the bending portion 401' of the armature 400' and the iron core 100' are increased, which effectively prevents the bending portion 401' of the armature 400' from touching or hitting the coil 200' and the iron core 100' during rotation of the bending portion 401' of the armature 400' about the inner side edge (pivot fulcrum) 312'.

A positioning step 412', as shown in FIG. 3, is formed on an outer side of the bending portion 401' of the armature 400' opposite to the iron core 100'. The inner side edge 312' of the end portion 310' of the first part 301' is positioned in a corner of the positioning step 412' of the armature 400'. In this way, the yoke 300' does not slide while the armature 400' is rotated about the inner side edge (pivot fulcrum) 312'.

What is claimed is:

1. A magnetic system of an electromagnetic relay, comprising:

a coil;

an iron core extending in a longitudinal direction through the coil and having a first end and a second end opposite to the first end;

a yoke having a first part and a second part connected to the first part, the second part of the yoke connected to the first end of the iron core and the first part of the yoke extending in the longitudinal direction of the iron core and separated from the coil, the first part of the yoke including an end portion bending away from a main body portion of the first part of the yoke such that an inner side facing the iron core and an outer side facing away from the iron core of the end portion are disposed at a distance further from the iron core in a direction transverse to the longitudinal direction of the iron core than an inner side facing the iron core and an outer side facing away from the iron core of the main body portion of the first part of the yoke; and an armature disposed at the second end of the iron core and having a main body and a bending portion bent from the main body by a predetermined angle, the main body facing an end surface of the second end of the iron core, the bending portion disposed at the inner side of the end portion of the first part of the yoke and facing the iron core, the bending portion including a positioning step disposed on an outer side thereof opposite the iron core, wherein an inner side edge of an end surface of the end portion of the first part of the yoke is disposed in the positioning step, the inner side edge serving as a pivot fulcrum for the armature.

2. The magnetic system of the electromagnetic relay of claim 1, wherein the predetermined angle is 70 to 110 degrees.

3. The magnetic system of the electromagnetic relay of claim 2, wherein the predetermined angle is 80 to 100 degrees.

4. The magnetic system of the electromagnetic relay of claim 3, wherein the predetermined angle is 85 to 95 degrees.

5. The magnetic system of the electromagnetic relay of claim 4, wherein the predetermined angle is 90 degrees.

6. The magnetic system of the electromagnetic relay of claim 1, wherein the iron core exerts a first electromagnetic attraction force on the main body of the armature, the first electromagnetic attraction force producing a first torque on the armature about the pivot fulcrum.

7. The magnetic system of the electromagnetic relay of claim 6, wherein the yoke exerts a second electromagnetic attraction force on the bending portion of the armature, the second electromagnetic attraction force producing a second torque on the armature about the pivot fulcrum.

8. The magnetic system of the electromagnetic relay of claim 7, wherein the first torque and the second torque have a same rotational direction about the pivot fulcrum.

9. The magnetic system of the electromagnetic relay of claim 1, wherein a cross sectional area of a magnetic gap between the yoke and the armature is defined by a surface area of the bending portion of the armature facing the yoke.

10. The magnetic system of the electromagnetic relay of claim 1, wherein the first part of the yoke is substantially parallel to an axis of the coil.

11. The magnetic system of the electromagnetic relay of claim 1, wherein the second part of the yoke is substantially perpendicular to the axis of the coil.

12. The magnetic system of the electromagnetic relay of claim 1, wherein an installation hole is formed in the second part of the yoke, the first end of the iron core fitted into the installation hole.

13. The magnetic system of claim 1, wherein the end portion of the first part of the yoke has a width equal to a width of the bending portion of the armature.

14. The magnetic system of the electromagnetic relay of claim 1, wherein the iron core has a round, oval, or polygonal cross section.

15. The magnetic system of the electromagnetic relay of claim 1, wherein the first part of the yoke has a length substantially equal to a length of the iron core.

* * * * *